US010208906B2

(12) United States Patent
Cordova

(10) Patent No.: US 10,208,906 B2
(45) Date of Patent: Feb. 19, 2019

(54) ULTRAVIOLET COURT-ILLUMINATION SYSTEM

(71) Applicant: Jason R. Cordova, Lake Mary, FL (US)

(72) Inventor: Jason R. Cordova, Lake Mary, FL (US)

( * ) Notice: Subject to any disclaimer, the term of this patent is extended or adjusted under 35 U.S.C. 154(b) by 136 days.

(21) Appl. No.: 15/289,394

(22) Filed: Oct. 10, 2016

(65) Prior Publication Data

US 2017/0102117 A1 Apr. 13, 2017

Related U.S. Application Data

(60) Provisional application No. 62/238,826, filed on Oct. 8, 2015.

(51) Int. Cl.

| | |
|---|---|
| ***A63F 9/00*** | (2006.01) |
| ***F21S 8/08*** | (2006.01) |
| ***A63B 43/06*** | (2006.01) |
| ***A63B 61/00*** | (2006.01) |
| ***A63C 19/00*** | (2006.01) |
| *F21W 131/10* | (2006.01) |
| *A63B 71/06* | (2006.01) |
| *A63C 19/08* | (2006.01) |

(52) U.S. Cl.

CPC ..... *F21S 8/085* (2013.01); *A63B 43/06* (2013.01); *A63B 61/003* (2013.01); *A63C 19/00* (2013.01); *A63B 71/0622* (2013.01); *A63B 2207/00* (2013.01); *A63C 2019/085* (2013.01); *A63C 2203/14* (2013.01); *F21W 2131/10* (2013.01)

(58) Field of Classification Search

None

See application file for complete search history.

(56) References Cited

U.S. PATENT DOCUMENTS

| | | | | |
|---|---|---|---|---|
| 3,222,509 | A * | 12/1965 | Thedford | E04H 17/00 256/1 |
| 3,971,560 | A * | 7/1976 | Panosh | A63B 67/04 273/DIG. 24 |
| 5,417,438 | A * | 5/1995 | Poff | A63B 71/02 273/DIG. 24 |
| 5,436,811 | A * | 7/1995 | Hecking | A01G 25/00 239/279 |
| 5,595,388 | A * | 1/1997 | Swigart | A63B 67/002 273/DIG. 26 |

(Continued)

*Primary Examiner* — Seng Heng Lim

(57) ABSTRACT

An ultraviolet court-illumination system is used to light a playing court and any related equipment in a fluorescent manner. The system includes at least one playing court, a first plurality of ultraviolet (UV) court lights, a plurality of fluorescent game boundary-markers, and at least one fluorescent game fixture. The playing court is used for playing games or sports. The plurality of fluorescent game boundary-markers is superimposed onto the playing court and is used to delineate the boundaries of the playing court. The fluorescent game fixture is mounted onto the playing court and may be a net, a goal, or any other fixture used to play the sport. Each of the first plurality of UV court lights is peripherally positioned about the playing court and is used to illuminate the fluorescent game boundary-markers and the fluorescent game fixture. The first plurality of UV court lights is powered by a power source.

5 Claims, 9 Drawing Sheets

(56) References Cited

U.S. PATENT DOCUMENTS

| | | | | |
|---|---|---|---|---|
| 6,508,732 | B1 * | 1/2003 | Romberger | A63B 39/06<br>273/DIG. 24 |
| 6,769,795 | B1 * | 8/2004 | Hale | A63B 61/00<br>362/152 |
| 8,827,848 | B1 * | 9/2014 | Washburn | A63B 67/18<br>473/473 |
| 2006/0176695 | A1 * | 8/2006 | Gordin | H05B 41/392<br>362/263 |

* cited by examiner

ULTRAVIOLET COURT-ILLUMINATION SYSTEM

The current application claims a priority to the U.S. Provisional Patent application Ser. No. 62/238,826 filed on Oct. 8, 2015. The current application is filed on Oct. 10, 2016 while Oct. 8, 2016 was on a weekend.

FIELD OF THE INVENTION

The present invention relates generally to systems for illuminating playing courts or fields. More specifically, the present invention is a system that is used to illuminate a playing court with ultraviolet light such that the court and any necessary game equipment are brightened in a fluorescent manner.

BACKGROUND OF THE INVENTION

Sports are enjoyed by millions of people across the world. For any given sport, there is not much variation in how the user experiences the game. As a result, playing the same sport again and again can become repetitive, causing players to lose enthusiasm for the game. Furthermore, lighting can be a limiting factor in when a sport can be played. At night, players generally use indoor or lit courts. Indoor courts are convenient but can become overcrowded very easily because the size of the building limits the number of courts that can fit inside. Outdoor lit courts provide another alternative; however, it can still be difficult to see for some players.

Accordingly, there is a present need for a playing court system which can excite players and provide the necessary lighting to participate in a sport. The present invention is an ultraviolet court-illumination system which is used to brighten a playing court in a distinct and exciting fashion. The system uses ultraviolet (UV) court lights which shine down upon at least one playing court. The playing court is fitted with fluorescent game boundary-markers and fluorescent game fixtures which shine bright under UV light. The fluorescent game fixture may be a net, a hoop, a goal, or any other equipment needed to play the sport. Further, a fluorescent game ball may be used to play the sport. When used together with the UV court lights, the playing court and all necessary equipment may be easily seen in an otherwise dark environment. As such, the present invention allows players to enjoy their favorite sports in a new and exciting way.

DETAILED DESCRIPTION OF THE INVENTION

All illustrations of the drawings are for the purpose of describing selected versions of the present invention and are not intended to limit the scope of the present invention.

Figure 1:
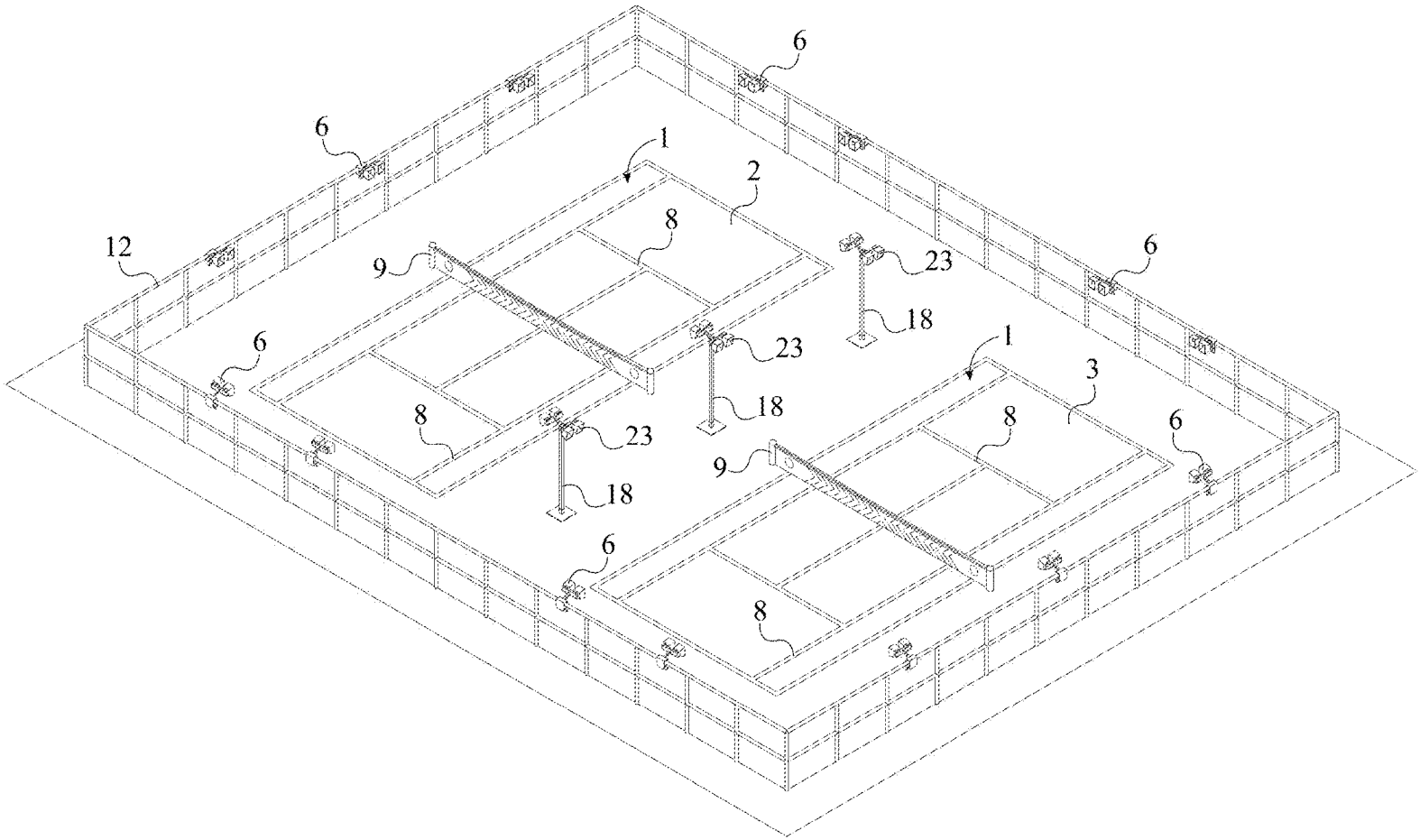
FIG. 1 is a perspective view of the present invention.
Figure 2:
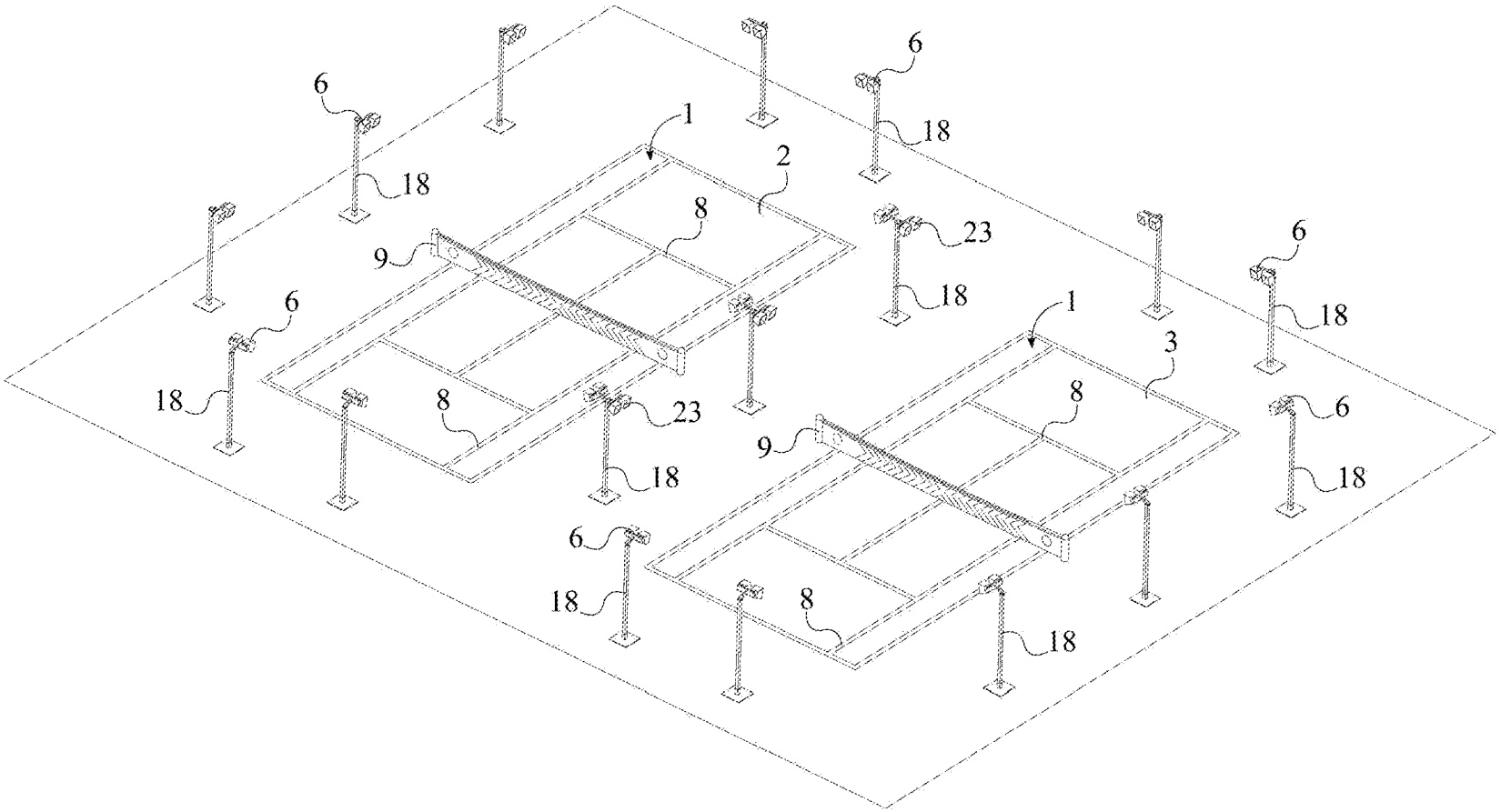
FIG. 2 is a perspective view of the second embodiment of the present invention, wherein the second embodiment uses the plurality of pole-mounting assemblies to mount the first plurality of UV court lights.
Figure 9:
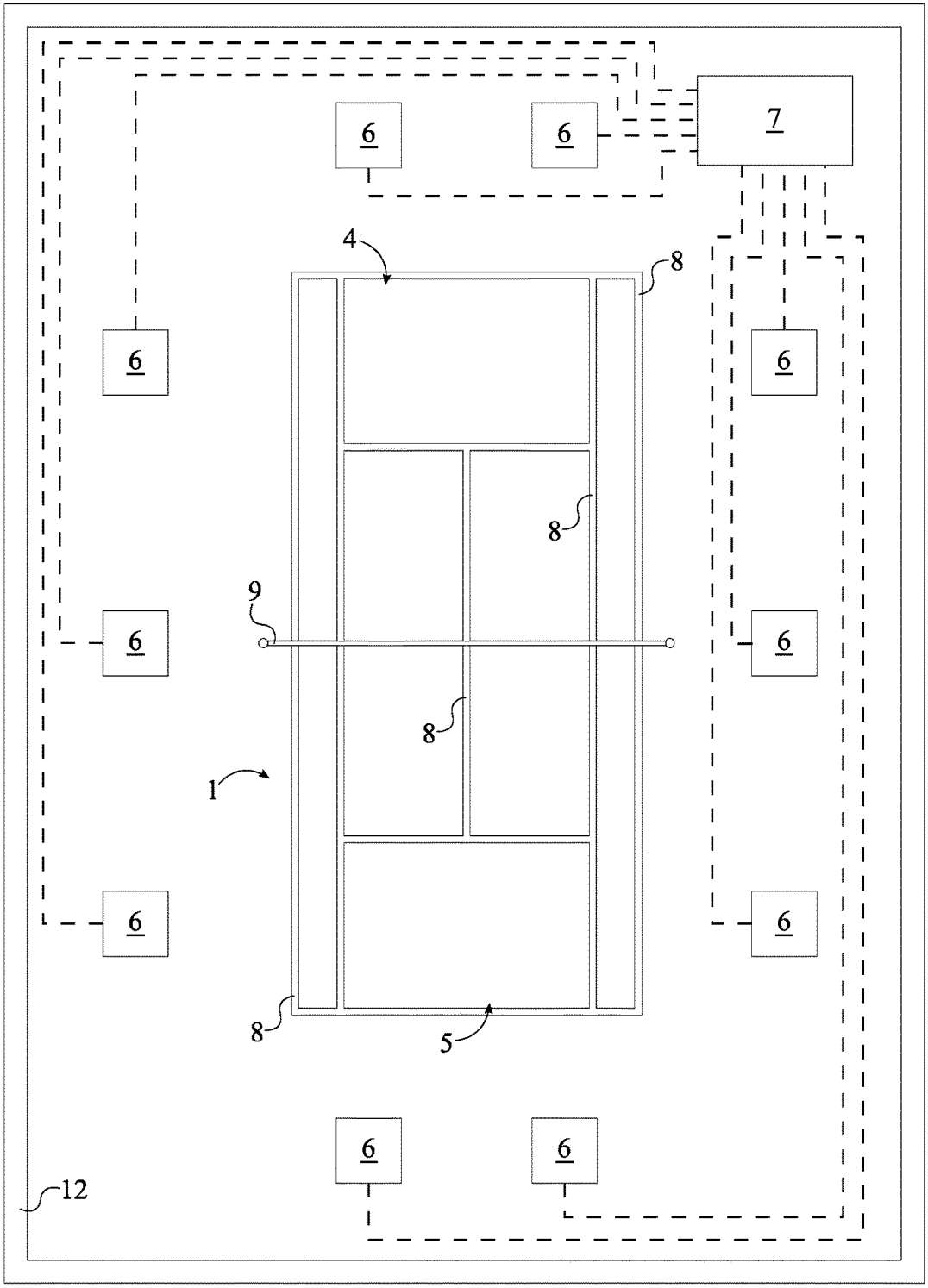
FIG. 9 is a schematic diagram of the present invention.

With reference to FIGS. 1-2, the present invention is an ultraviolet court-illumination system used for playing games or sports. The present invention uses ultraviolet lights to allow players to participate in games in a dark or dim setting by illuminating the court and necessary equipment in a fluorescent manner. The present invention comprises at least one playing court 1, a first plurality of ultraviolet (UV) court lights 6, at least one power source 7, a plurality of fluorescent game boundary-markers 8, and at least one fluorescent game fixture 9. The first plurality of UV court lights 6 shines on the plurality of fluorescent game boundary-markers 8 and the at least one fluorescent game fixture 9 so that players can adequately see while playing. The plurality of fluorescent game boundary-markers 8 is superimposed onto and across the playing court 1. The plurality of fluorescent game boundary-markers 8 is used to delineate the borders of the playing court 1 and may further be used to delineate different areas within the playing court 1. The at least one fluorescent game fixture 9 is mounted onto the playing court 1 and is used for playing the game or sport. For example, if the playing court 1 is a tennis court, the fluorescent game fixture 9 may be a customized net that shines under the first plurality of UV court lights 6. The first plurality of UV court lights 6 is peripherally positioned about the playing court 1 and is positioned to illuminate the playing court 1. In reference to FIG. 9, Each of the first plurality of UV court lights 6 is electrically connected to the power source 7. The power source 7 is positioned adjacent to the playing court 1, allowing for easy access. In the preferred embodiment, the power source 7 is a generator; however, the power source 7 may come in the form of an electric grid or some other source.

In reference to FIG. 1, the preferred embodiment of the present invention further comprises a fence 12. The fence 12 is peripherally positioned about the playing court 1. Like the fences which surround most tennis courts, the fence 12 is used to prevent balls or other equipment from being lost or expelled far from the playing court 1. The first plurality of UV court lights 6 is mounted onto the fence 12 and is distributed about the fence 12. This arrangement allows the first plurality of UV court lights 6 to be positioned out of the way of the playing court 1. The fence 12 may be covered in a plurality of fluorescent fence decorations in order to enhance the experience of the user and to aid the user in perceiving depth in an otherwise dark setting.

Figure 3:
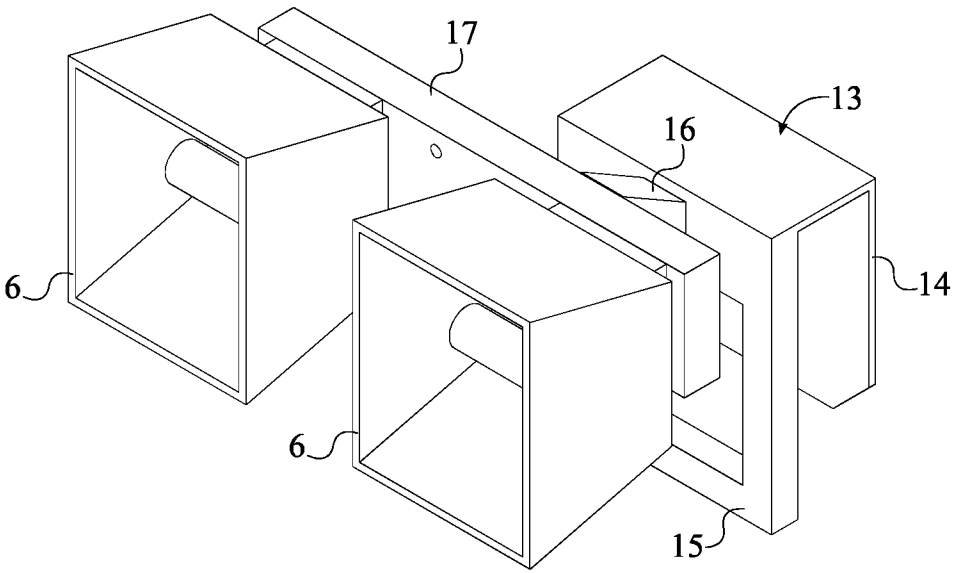
FIG. 3 is a perspective view of two of the first plurality of UV court lights mounted onto a fence bracket through a fence rack.
Figure 4:
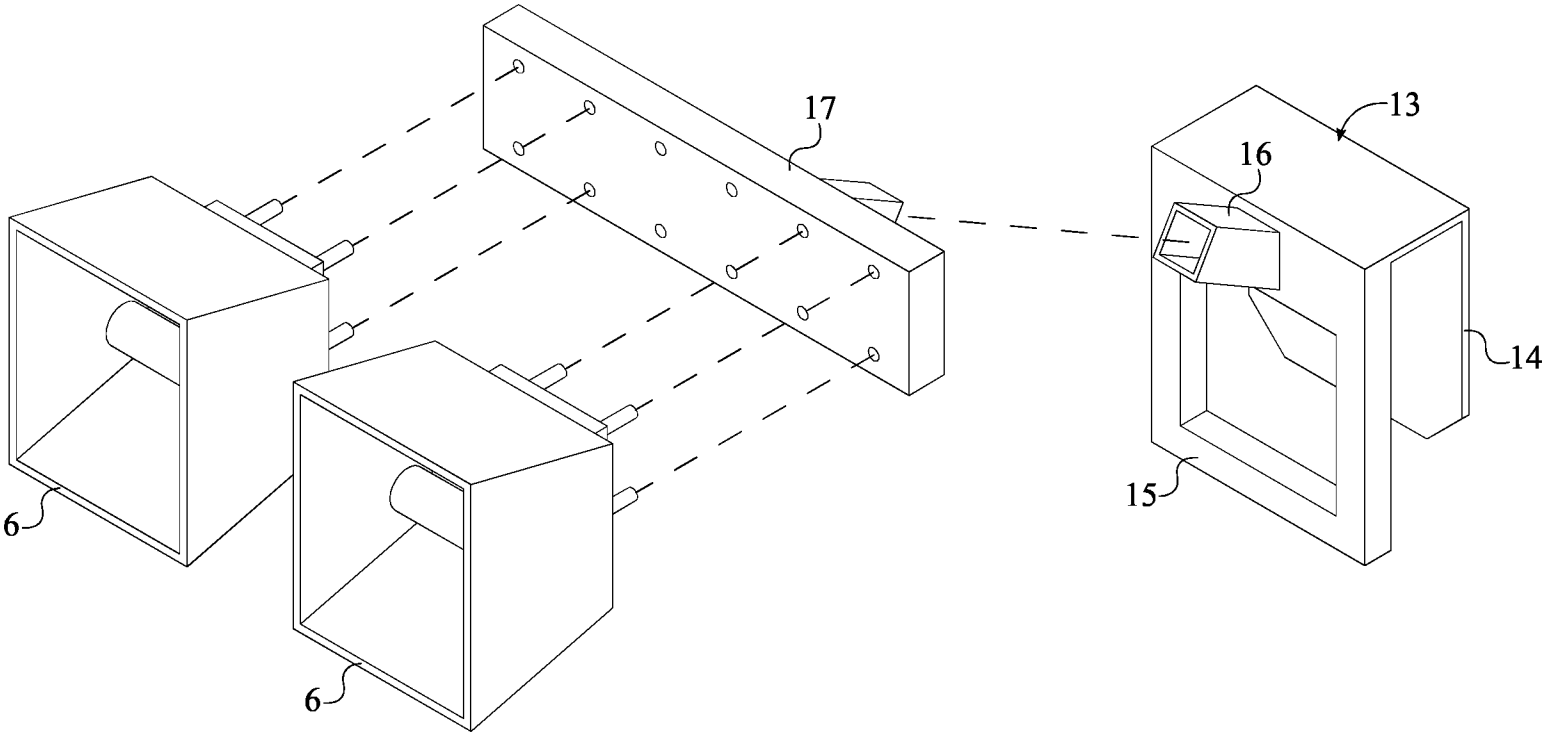
FIG. 4 is an exploded perspective view showing how two of the first plurality of UV court lights are mounted onto the fence bracket through the fence rack

In reference to FIG. 1 and FIGS. 3-4, the present invention further comprises a plurality of fence-mounting brackets 13. The plurality of fence-mounting brackets 13 is used to secure each of the first plurality of UV court lights 6 to the fence 12. Each of the plurality of fence-mounting brackets 13 comprises a fence hanger 14, a mounting plate 15, and a mounting tube 16. The fence hanger 14 is connected adjacent to the mounting plate 15. The fence hanger 14 is mounted onto the fence 12 such that the mounting plate 15 is oriented toward the playing court 1. The mounting tube 16 is mounted adjacent to the mounting plate 15, opposite to the fence hanger 14. This arrangement allows the first plurality of UV court lights 6 to be secured to the fence 12 and oriented towards the playing court 1. Each of the first plurality of UV court lights 6 is mounted onto the fence 12 by the mounting tube 16 of a corresponding bracket, wherein the corresponding bracket is from the plurality of fence-mounting brackets 13.

In reference to FIGS. 3-4, each of the plurality of fence-mounting brackets 13 further comprises a fence rack 17. The fence rack 17 allows more than one of the first plurality of UV court lights 6 to be mounted to a corresponding bracket. The fence rack 17 is attached onto the mounting tube 16, opposite to the mounting plate 15. The fence rack 17 may be oriented normal to the playing court 1 or parallel to the playing court 1, depending on the needs of the user. A set of designated lights is hung along the fence rack 17, wherein the set of designated lights is from the first plurality of UV court lights 6. The set of designated lights may contain any number of the first plurality of UV court lights 6 to provide more light as needed.

Figure 5:
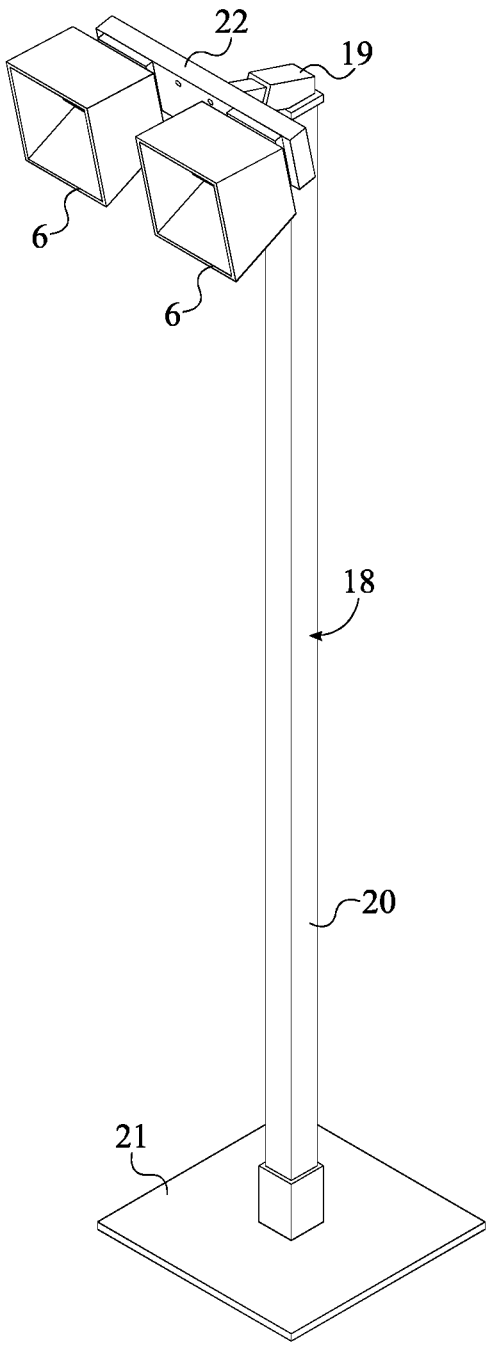
FIG. 5 is a perspective view of two of the first plurality of UV court lights mounted onto a pole-mounting assembly through a pole rack.
Figure 6:
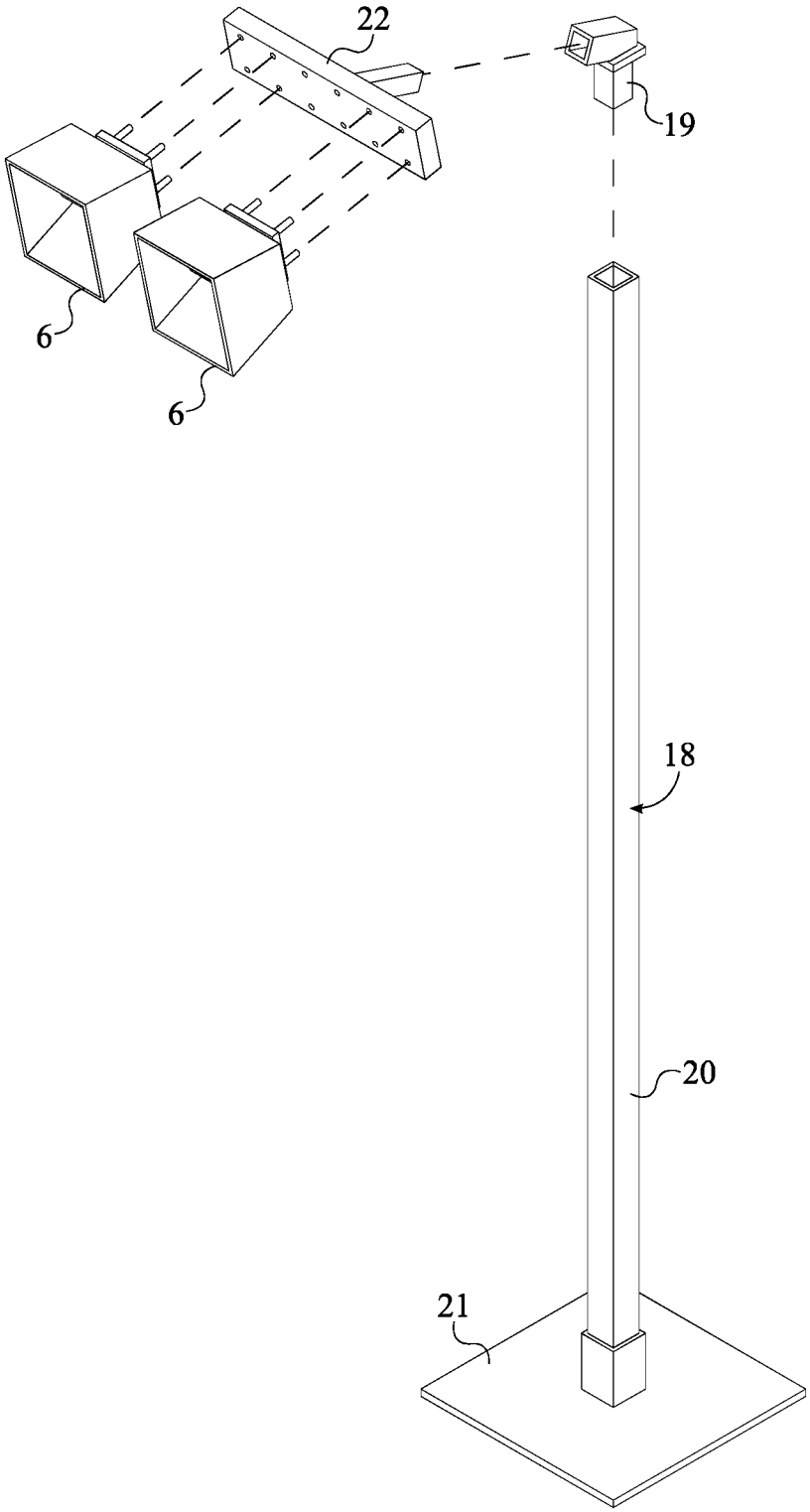
FIG. 6 is an exploded perspective view showing how two of the first plurality of UV court lights are mounted onto the pole-mounting assembly through the pole rack.

In a second embodiment of the present invention, shown in FIG. 2 and FIGS. 5-6, the present invention further comprises a plurality of pole-mounting assemblies 18. The plurality of pole-mounting assemblies 18 is used to station each of the first plurality of UV court lights 6 in an elevated position and so as to not infringe on the playing court 1. Each of the pole-mounting assemblies 18 comprises a pole-mounting bracket 19, a pole 20 and a base panel 21. The pole 20 is connected normal to the base panel 21 and is used to elevate one or more of the first plurality of UV court lights 6. The base panel 21 provides a stable platform upon which the pole 20 can stand. The pole-mounting bracket 19 is mounted into the pole 20, opposite to the base panel 21. The pole-mounting bracket 19 may be permanently connected to the pole 20 or may be removably attached, depending on the needs of the user. This gives the user the option to easily set up and tear down the present invention or to create permanent installations. Each of the first plurality of UV court lights 6 is connected adjacent to the pole-mounting bracket 19 of a corresponding pole-mounting assembly 18, wherein the corresponding pole-mounting assembly 18 is from the plurality of pole-mounting assemblies 18.

In reference to FIGS. 5-6, each of the plurality of pole-mounting assemblies 18 further comprises a pole rack 22. Similar to the fence rack 17, the pole rack 22 allows more than one of the first plurality of UV court lights 6 to be mounted to a corresponding pole-mounting assembly 18. The pole rack 22 is attached onto the pole-mounting bracket 19, opposite to the pole. The pole rack 22 may be oriented normal to the playing court 1 or parallel to the playing court 1, depending on the needs of the user. Further, the pole rack 22 may be adjusted vertically in order to position the first plurality of UV court lights 6 so that visibility is optimized for players and spectators. A set of designated lights is hung along the pole rack 22, wherein the set of designated lights is from the first plurality of UV court lights 6. The set of designated lights may contain any number of the first plurality of UV court lights 6 to provide more light as needed.

In a third embodiment of the present invention, the plurality of pole-mounting assemblies 18 is used to suspend the first plurality of UV court lights 6. In this embodiment, the present invention further comprises a plurality of suspension wires. The plurality of suspension wires is used to hang each of the first plurality of UV court lights 6. To do this, each of the suspension wires is tethered in between the pole-mounting bracket 19 of an arbitrary pole-mounting assembly 18 and the pole-mounting bracket 19 of an adjacent pole-mounting assembly 18. Both the arbitrary pole-mounting assembly 18 and the adjacent pole-mounting assembly 18 are from the plurality of pole-mounting assemblies 18. With this arrangement, each of the first plurality of UV court lights 6 is hung from a corresponding wire from the plurality of suspension wires. More than one of the first plurality of UV court lights 6 may be hung from a single suspension wire. This allows more of the first plurality of UV court lights 6 to be positioned with fewer pole-mounting assemblies 18.

In the event that the playing court 1 is a tennis court, a first net pole assembly and a second net pole assembly may be used to mount lights from the first plurality of UV court lights 6. In this embodiment, the first net pole assembly is laterally mounted to a first net post of the playing court 1. Similarly, the second net pole assembly is laterally mounted to a second net post of the playing court 1. This arrangement functions similarly to the plurality of pole-mounting assemblies 18; however, instead of using base panels 21, the first net pole 20 assembly and the second net pole 20 assembly are anchored to the first net post and the second net post, respectively.

In reference to FIGS. 1-2, the present invention is designed to work for use with multiple playing courts 1. For example, the at least one playing court 1 can comprise a first court 2 and a second court 3. In this situation, it is necessary to provide more lighting without crowding the first court 2 and the second court 3. The present invention further comprises a second plurality of UV court lights 23 which runs in between the first court 2 and the second court 3 to better illuminate both courts. The first court 2 is positioned adjacent to the second court 3. In this situation, the first plurality of UV court lights 6 is peripherally positioned about the first court 2 and the second court 3. The addition of a second court 3 does not affect how the first plurality of UV court lights 6 are mounted. The first plurality of UV court lights 6 may still be mounted onto the fence 12 or through the plurality of pole-mounting assemblies 18. The second plurality of UV court lights 23 is positioned in between the first court 2 and the second court 3.

In reference to FIGS. 1-2, the preferred method of mounting the second plurality of UV court lights 23 is through the plurality of pole-mounting assemblies 18. Each of the second plurality of UV court lights 23 is connected adjacent to the pole 20 bracket of a corresponding pole-mounting assembly 18, wherein the corresponding pole-mounting assembly 18 is from the plurality of pole-mounting assemblies 18. In reference to FIGS. 5-6, one or more of the second plurality of UV court lights 23 may be mounted onto a single corresponding pole-mounting assembly 18 through the use of the pole rack 22. This helps to limit the number of pole-mounting assemblies 18 between the first court 2 and the second court 3. The pole rack 22 may be oriented normal to the playing court 1 or parallel to the playing court 1, depending on the needs of the user. Further, the pole rack 22 may be adjusted vertically in order to position the second plurality of UV court lights 23 so that visibility is optimized for players and spectators. A set of designated lights is hung along the pole rack 22, wherein the set of designated lights is from the second plurality of UV court lights 23. The set of designated lights may contain any number of the second plurality of UV court lights 23 to provide more light as needed.

Figure 7:
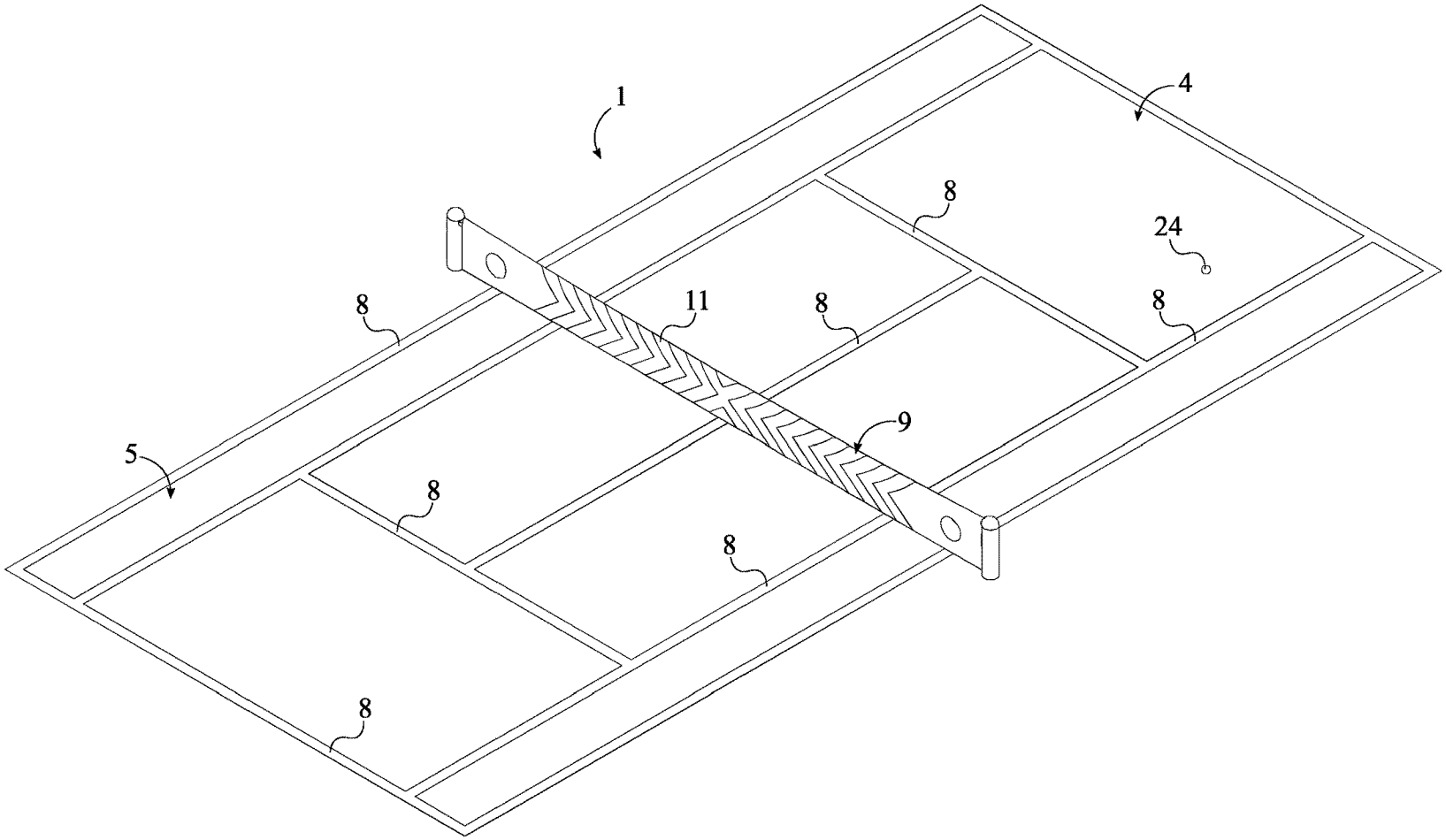
FIG. 7 is a perspective view of the playing court with the alternative embodiment of the fluorescent game fixture, wherein alternative embodiment of the fluorescent game fixture comprises a net and a net cover.

In reference to FIG. 7, the present invention further comprises a fluorescent game ball 24. The fluorescent game ball 24 is used to play a game or sport on the playing court 1. The fluorescent game ball 24 may be a tennis ball, a basketball, a volleyball, a soccer ball, or any other type of ball. During play, the fluorescent game ball 24 is bounded within the playing court 1. Depending on the game or sport, the present invention may comprise more than one fluorescent game ball 24 as needed by the user.

In reference to FIG. 1, in the preferred embodiment of fluorescent game fixture 9, the fluorescent game fixture 9 is a fluorescent net which can be used to play tennis. To match a common tennis court, the playing court 1 comprises a first half 4 and a second half 5. The first half 4 is positioned adjacent to the second half 5. Like a tennis net, the fluorescent game fixture 9 is mounted across the playing court 1 and is positioned in between the first half 4 and the second half 5. This embodiment would be useful for a permanent setup used under UV light. Although the preferred embodiment of the present invention is designed for playing tennis, it is to be understood that the playing court 1 and the at fluorescent game fixture 9 may be tailored for any game or sport.

Figure 8:
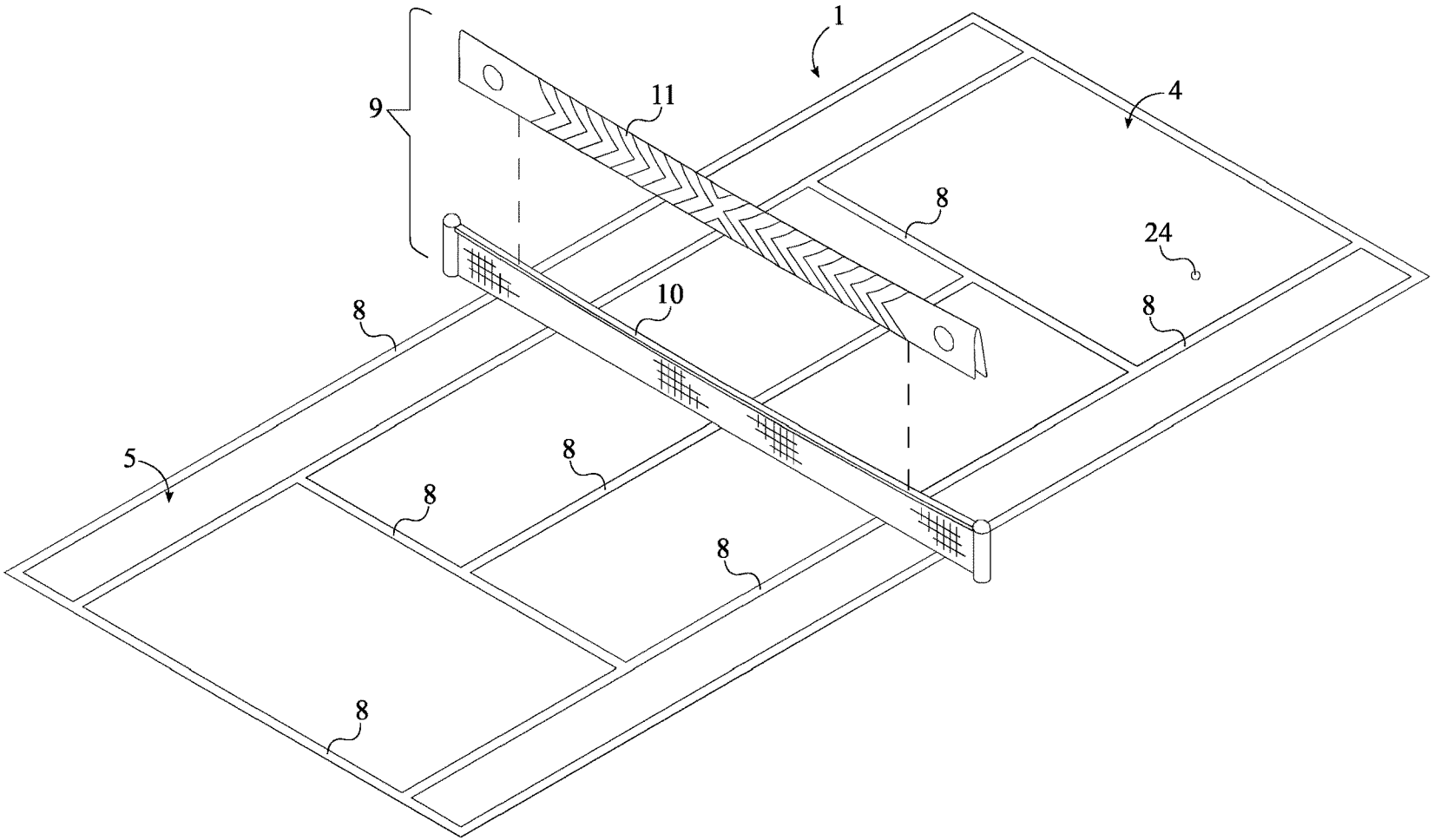
FIG. 8 is a perspective view of the playing court with the alternative embodiment of the fluorescent game fixture shown in an exploded view.

In an alternative embodiment of the fluorescent game fixture 9, shown in FIGS. 7-8, the fluorescent game fixture 9 comprises a net 10 and a fluorescent cover 11. In this embodiment, the net 10 resembles a traditional tennis net. The net 10 is mounted across the playing court 1 and is positioned in between the first half 4 and the second half 5. The fluorescent cover 11 is draped over the net 10 and is used to make the net 10 visible under UV light. This embodiment allows an existing tennis court to be used as the playing court 1, with the fluorescent cover 11 being used as a retrofit.

Although the invention has been explained in relation to its preferred embodiment, it is to be understood that many other possible modifications and variations can be made without departing from the spirit and scope of the invention as hereinafter claimed.

What is claimed is:

1. An ultraviolet court-illumination system comprising:
at least one playing court;
a plurality of first ultraviolet (UV) courts devices;
at least one power source;
a plurality of fluorescent game boundary-markers;
at least one fluorescent game fixture;
a fence;
a plurality of fence-mounting assemblies;
the plurality of fluorescent game boundary-markers being superimposed onto and across the at least one playing court;
the at least one fluorescent fixture being mounted onto the at least one playing court;
the plurality of first UV court light devices being adjacently positioned about the at least one playing court;
each of the plurality of first UV courts light devices being electrically connected to the at least one power source;
the at least one power source being positioned adjacent to the at least one playing court;
the fence being peripherally positioned about the at least one playing court;
the plurality of first UV court light devices being mounted onto the fence by the plurality of fence-mounting assemblies;
the plurality of first UV court light devices being distributed about the fence;
each of the plurality of first UV court light devices comprising a set of first designated lights;
each of the plurality of fence-mounting assemblies comprising a fence hanger, a mounting plate, a mounting tube and a fence rack, the fence hanger being connected to the mounting plate, the mounting plate being connected to the mounting tube, the mounting tube being connected to the fence rack, the mounting plate being connected in between the fence hanger and the mounting tube, the mounting tube being connected in between the mounting plate and the fence rack, the fence hanger being mounted onto the fence; and
the set of first designated lights of a corresponding first UV court light device among the plurality of first UV court light devices being hung along the fence rack of a corresponding fence-mounting assembly among the plurality of fence-mounting assemblies.

2. The ultraviolet court-illumination system as claimed in claim 1 comprising:
a plurality of second UV courts light devices;
a plurality of pole-mounting assemblies;
the plurality of second UV courts light devices being adjacently positioned about the at least one playing court;
each of the plurality of second UV court light devices being electrically connected to the at least one power source;
each of the plurality of second UV court light devices comprising a set of second designated lights;
each of the plurality of pole-mounting assemblies comprising a base panel, a pole, a pole-mounting bracket and a pole rack, the base panel being connected to the pole, the pole being connected to the pole-mounting bracket, the pole-mounting bracket being connected to the pole rack, the pole being connected in between the base panel and the pole-mounting bracket, the pole-mounting bracket being connected in between the pole and the pole rack, the base panel being adjacently positioned about the at least one playing court; and
the set of second designated lights of a corresponding second UV court light device among the plurality of second UV court light devices being hung along the pole rack of a corresponding pole-mounting assembly among the plurality of pole-mounting assemblies.

3. The ultraviolet court-illumination system as claimed in claim 1 comprising:
a fluorescent game ball; and
the fluorescent game ball being bounded within the at least one playing court.

4. The ultraviolet court-illumination system as claimed in claim 1 comprising:
the fluorescent game fixture being mounted across the at least one playing court;
the fluorescent game fixture comprising a fluorescent net;
the at least one playing court comprising a first half and a second half;
the first half being positioned adjacent to the second half; and
the fluorescent net being positioned in between the first half and the second half.

5. The ultraviolet court-illumination system as claimed in claim 1 comprising:

the fluorescent game fixture being mounted across the at least one playing court;

the fluorescent game fixture comprising a net and a fluorescent cover;

the at least one playing court comprising a first half and a second half;

the first half being positioned adjacent to the second half;

the net being positioned in between the first half and the second half; and the fluorescent cover being draped over the net.

* * * * *